US006847172B2

(12) United States Patent
Suzuki

(10) Patent No.: US 6,847,172 B2
(45) Date of Patent: Jan. 25, 2005

(54) PIXEL DRIVING CIRCUIT SYSTEM AND METHOD FOR ELECTROLUMINESCENT DISPLAY

(75) Inventor: Hiroshi Suzuki, Yamato (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/294,230

(22) Filed: Nov. 14, 2002

(65) Prior Publication Data

US 2003/0098657 A1 May 29, 2003

(30) Foreign Application Priority Data

Nov. 28, 2001 (JP) ..... 2001-362672

(51) Int. Cl.[7] ..... G09G 3/10
(52) U.S. Cl. ..... 315/169.3; 345/76; 345/78
(58) Field of Search ..... 315/169.3; 345/36, 345/39, 45–46, 55, 76–77, 92, 78

(56) References Cited

U.S. PATENT DOCUMENTS 4,006,383 A * 2/1977 Luo et al. ..... 315/169.3
5,670,792 A * 9/1997 Utsugi et al. ..... 257/59
6,204,610 B1 * 3/2001 Komiya ..... 315/169.3
6,633,270 B2 * 10/2003 Hashimoto ..... 345/76

* cited by examiner

*Primary Examiner*—Thuy Vinh Tran
(74) *Attorney, Agent, or Firm*—H. Daniel Schnurmann

(57) ABSTRACT

Accurate gradation display on an OLED display device is effectuated by reducing a kickback voltage based on parasitic capacitance of a switching TFT without increasing a capacitance of a capacitor which retains a voltage to be supplied to a driving TFT. A capacitor for maintaining on-and-off states of a driving TFT which drives an OLED is charged by a switching TFT. The capacitor is connected to a scan line, which drives a switching TFT located in a preceding stage in accordance with a scanning order. After being charged by the switching TFT, a reference potential on the capacitor is raised to compensate for a drop in a gate voltage of the driving TFT attributable to parasitic capacitance of the switching TFT, in accordance with a signal from the scan line.

12 Claims, 9 Drawing Sheets

PIXEL DRIVING CIRCUIT SYSTEM AND METHOD FOR ELECTROLUMINESCENT DISPLAY

FIELD OF THE INVENTION

The present invention relates to illuminated displays, a more specifically to a system and method for driving an organic light emitting diode pixel circuit in an organic electroluminescent display device.

BACKGROUND OF THE INVENTION

An organic electroluminescent (EL) display is a flat panel display for use as a computer or television monitor. A preferred method of driving an organic EL display is by an active matrix driving method, which provides a high-quality display image, while eliminating crosstalk. In an active matrix driving method, a thin-film transistor (TFT) is generally used as a switching element for an organic light emitting diode (OLED). OLED's are EL elements which operate by organic electroluminescence (EL).

FIG. 7 is a view showing a general constitution of an OLED pixel circuit driven by a TFT. With reference to FIG. 7, a conventional OLED pixel circuit includes an OLED 711 which is a light-emitting element, a driving TFT 712 for driving the OLED 711, a switching TFT 713 and a capacitor 714. A gate electrode of the driving TFT 712 is connected to the output of a switching TFT 713 and the capacitor 714. When a sufficient voltage is applied to the gate electrode of driving TFT 712, a driving electric current on a supply line 721 is supplied to the OLED 711 to allow the OLED 711 to emit light.

A gate electrode of the switching TFT 713 is connected to scan line 722. In accordance with a driving voltage on this scan line 722, a voltage obtained from a signal line 723 is applied to the gate electrode of the driving TFT 712. The capacitor 714 is connected to an output of the switching TFT 713 at one terminal, and also connected to a capacitor line 724 at another of its terminals. The capacitor 714 is charged by the switching TFT 713 and retains a voltage to be applied to the gate electrode of the driving TFT 712. Depending on the circuit arrangement, the capacitor line 724 may be arranged as a ground line, or the supply line 721 may be also used as the capacitor line 724.

TFT's have parasitic capacitance, attributable to their stacked structure, which includes electrodes, an insulating layer, a semiconductor layer and the like. In the switching TFT 713, a signal waveform (a scanning pulse) of the scan line 722 changes the electric potential retained by the capacitor 714 due to parasitic capacitance (Cgs) between a gate and a source of switching TFT 713. Such voltage which changes the electric potential of the capacitor 714 is referred to as a kickback voltage.

A change in voltage at the capacitor 714 is identical to the gate potential of the driving TFT 712 which drives the OLED 711. Accordingly, if the electric potential of the capacitor 714 declines, the driving electric current to be supplied to the OLED 711 is reduced, whereby emission luminance of the OLED 711 will be reduced.

FIG. 8 is a view showing the relationship between the signal waveform on the scan line 722, the electric potential of the capacitor 714, and the emission luminance of the OLED 711. As shown in the drawing, the signal waveform on the scan line 722 includes an addressing period when the switching TFT 713 is turned on, and a driving period when the switching TFT 713 is turned off. As shown in FIG. 8, when the scan line signal 722 changes from the addressing period to the driving period, the electric potential of the capacitor 714 is reduced in the amount of the kickback voltage, which in turn reduces the emission luminance of the OLED 711. Thus, in EL displays operated by an active matrix driving method using TFTs, the emission luminance of the OLED is reduced by the kickback voltage generated at each OLED pixel circuit arising from the parasitic capacitance of the switching TFT. In addition, the gate voltage of the driving TFT 712 changes due to the kickback voltage, and is amplified by the driving TFT 712 as a change in the driving electric current of the OLED.

The light emission characteristic of the OLED is very steeply dependent on the driving voltage. For this reason, the decrease in the gate voltage of the driving TFT attributable to the kickback voltage greatly decreases the emission luminance of the OLED, whereby correct gradation display is impeded. Moreover, display unevenness occurs over the entire organic EL display.

FIG. 9 is a graph illustrating the relationship of the driving voltage to the light emission characteristic of the OLED. Referring to FIG. 9, a small change in the driving voltage (delta)Vkb, in an amount comparable to the kickback voltage, effects a large change in the emission luminance of the OLED.

In order to reduce the effect of kickback voltage on the gate voltage of the driving TFT, one might increase capacitance by increasing the size of capacitor 714, such that change due to the kickback voltage is reduced. However, since capacitor 714 is formed on the scan line in an actual OLED pixel circuit, it is necessary to increase a width of the scan line in order to increase capacitance. That is undesirable, as it leads to a decrease in the emission-contributable area of the OLED pixel circuit instead.

Another way might be to increase the electric current supplied to the OLED to cope with reduced emission efficiency due to decrease in the emission-contributable area. However, the OLED (the organic EL) deteriorates faster under increased current density, thus shortening its lifetime. Therefore, increasing the electric current is not desirable.

SUMMARY OF THE INVENTION

Therefore, an object of the present invention is to effectuate correct gradation display on an OLED display device by reducing a kickback voltage attributable to parasitic capacitance of a switching TFT.

Moreover, another object of the present invention is to provide an OLED pixel circuit and a driving method thereof, which are capable of reducing a kickback voltage attributable to parasitic capacitance at a switching TFT without increasing the capacitance of a capacitor which retains a voltage to be supplied to a driving TFT.

Accordingly, the present invention is embodied in a pixel driving circuit system and method in which a capacitor is charged which applies a voltage to a gate electrode of a driving thin-film transistor to drive said electroluminescent element, by turning a switching thin-film transistor on; and then turning off the switching thin-film transistor and changing a reference potential of the capacitor to compensate for a drop in a gate voltage of the driving thin-film transistor which is attributable to parasitic capacitance of the switching thin-film transistor.

BRIEF DESCRIPTION OF THE DRAWINGS

For a more complete understanding of the present invention and the advantages thereof, reference is now made to the following description taken in conjunction with the accompanying drawings.

DETAILED DESCRIPTION OF THE PREFERRED EMBODIMENTS

Figure 1:
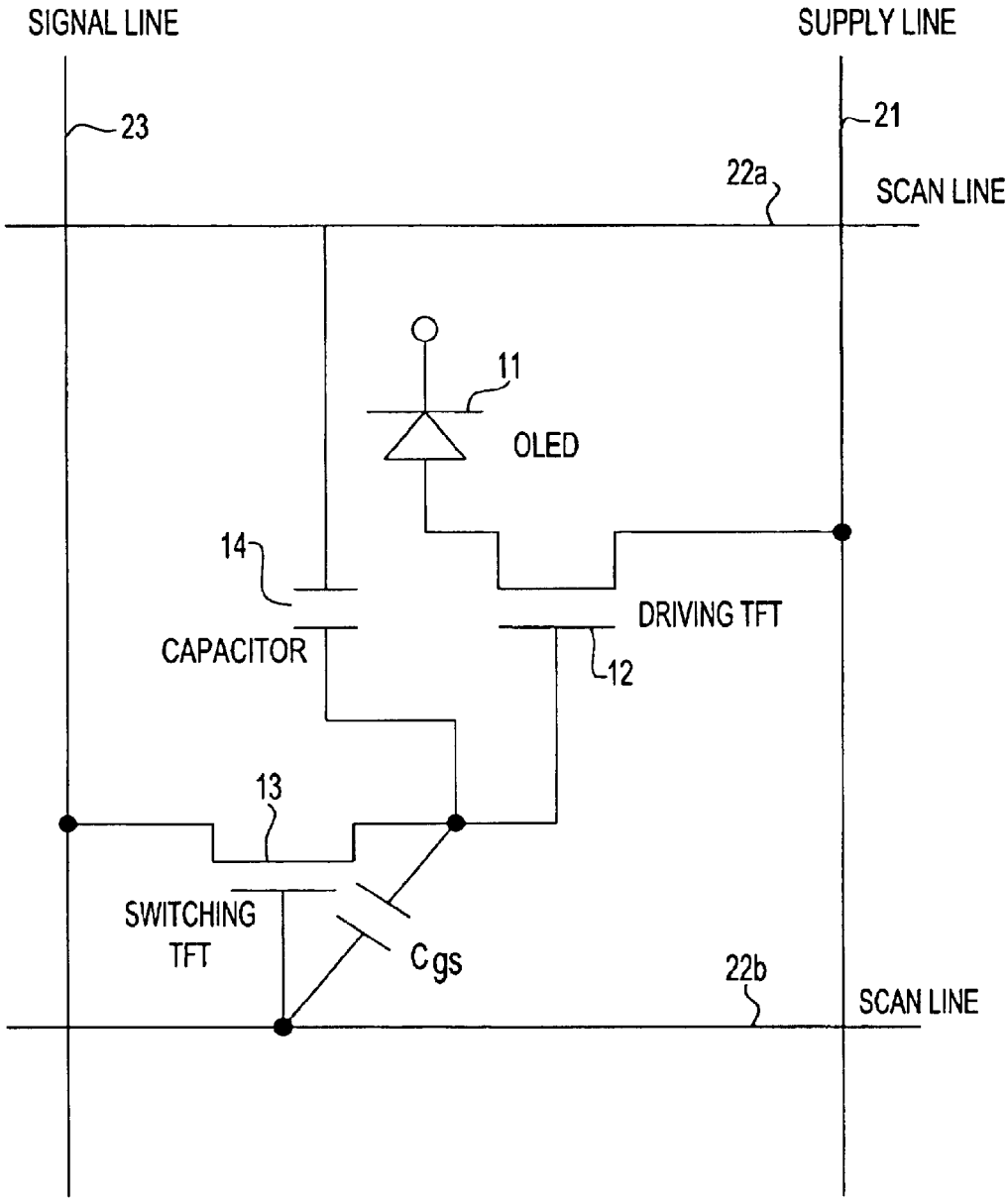
FIG. 1 is a view showing a constitution of an OLED pixel circuit according to an embodiment of the present invention.

Embodiments of the invention will now be described with reference to the accompanying drawings. FIG. 1 is a diagram illustrating an OLED pixel circuit according to an embodiment. With reference to FIG. 1, the OLED pixel circuit of the embodiment includes an OLED 11 which is a light emitting element, a driving TFT 12 coupled to drive the OLED 11, a switching TFT 13 and a capacitor 14, those being disposed in a space surrounded by a supply line 21, scan lines 22 and a signal line 23 in gridiron. Moreover, a display panel for an organic EL display is made of a pixel array in which OLED pixel circuits of FIG. 1 are arranged in a matrix, as shown schematically in FIG. 2.

Figure 2:
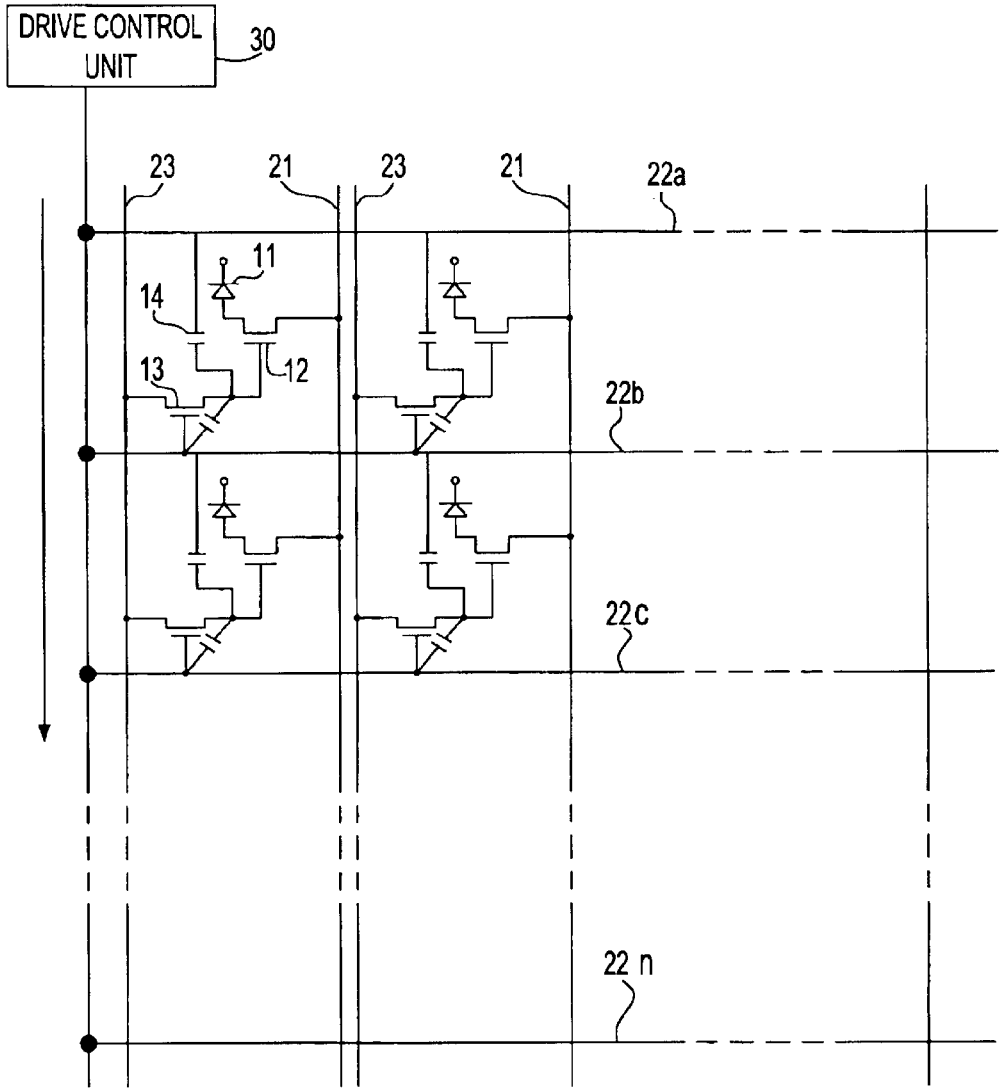
FIG. 2 is a view illustrating a pixel array of an organic EL display, of the OLED pixel circuits as shown in FIG. 1.

In FIG. 2, a drive control unit 30 includes scan pulse generating means for generating a scan pulse which instructs imaging timing to display an image on the display panel, and outputting means to output the scan pulse to each scan line 22*a*, 22*b*, 22*c*, etc. to supply the scan pulse to each of the OLED pixel circuits. In the illustrated display panel, a drive voltage (an addressing period and a driving period of a signal waveform) for each of the scan lines 22*a*, 22*b*, 22*c*, etc., will be switched by the scan pulse transmitted from the drive control unit 30 in accordance with a scanning order, as indicated by an arrow in the drawing. It should be noted that FIG. 2 describes only characteristic constitutions in the embodiment. Although it is not particularly illustrated, it is needless to say that the organic EL display is provided with a power source for supplying a voltage to the supply lines 21, and imaging controlling means for supplying imaging signals based on image data to the signal lines 23.

In FIG. 1, the OLED 11 emits light when a drive current is present, which is supplied from the supply line 21 connected to the OLED 11 via the driving TFT 12. A gate electrode of the driving TFT 12 is connected to the switching TFT 13 and the capacitor 14. When a voltage is applied to the gate electrode, the driving TFT 12 delivers the drive current from the supply line 21 to the OLED 11 to emit light.

A gate electrode of the switching TFT 13 is connected to the scan line 22*b*. The switching TFT 13 applies a voltage from the signal line 23 to the gate electrode of the driving TFT 12 when the voltage on the scan line 22*b* is raised, as timed by the scan pulse.

Figure 7:
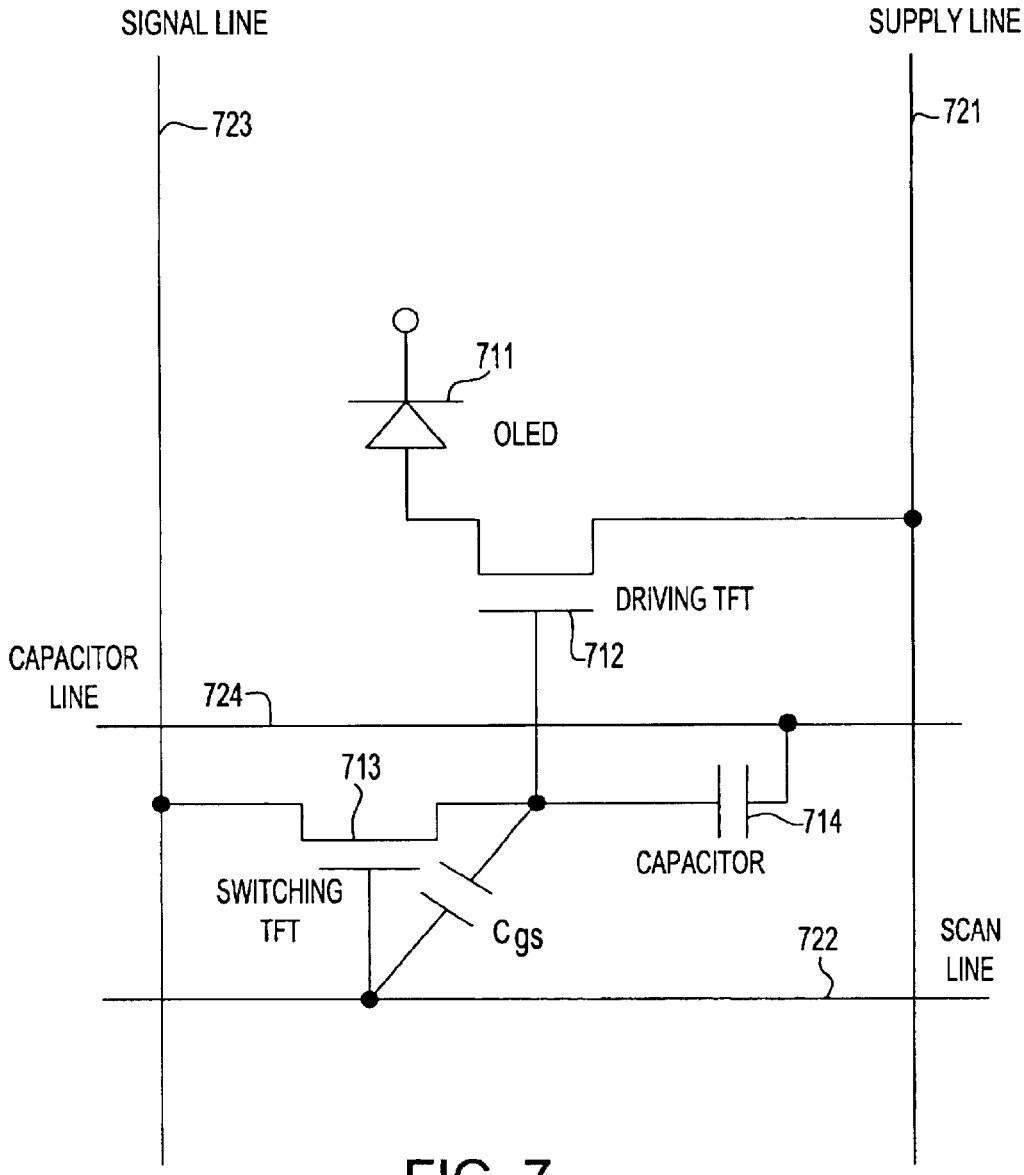
FIG. 7 (PRIOR ART)
FIG. 7 is a prior art circuit diagram for an OLED pixel circuit driven by a TFT.

The capacitor 14 has a terminal connected to the switching TFT 13 and another terminal connected to the scan line 22*a* of a preceding stage in accordance with the scanning order (see FIG. 2 and accompanying description above). The capacitor 14 is charged by the switching TFT 13 to a voltage to be applied to the gate electrode of the driving TFT 12. Since the capacitor 14 is connected to the scan line 22*a*, the capacitor line for the capacitor 714 as illustrated in FIG. 7 is not provided therein. According to the embodiment, in the OLED pixel circuit having the above-described arrangement, the adverse effect of the kickback voltage in lowering the gate voltage of the driving TFT 12 is reduced by applying a new signal waveform on the scan lines 22.

Figure 3:
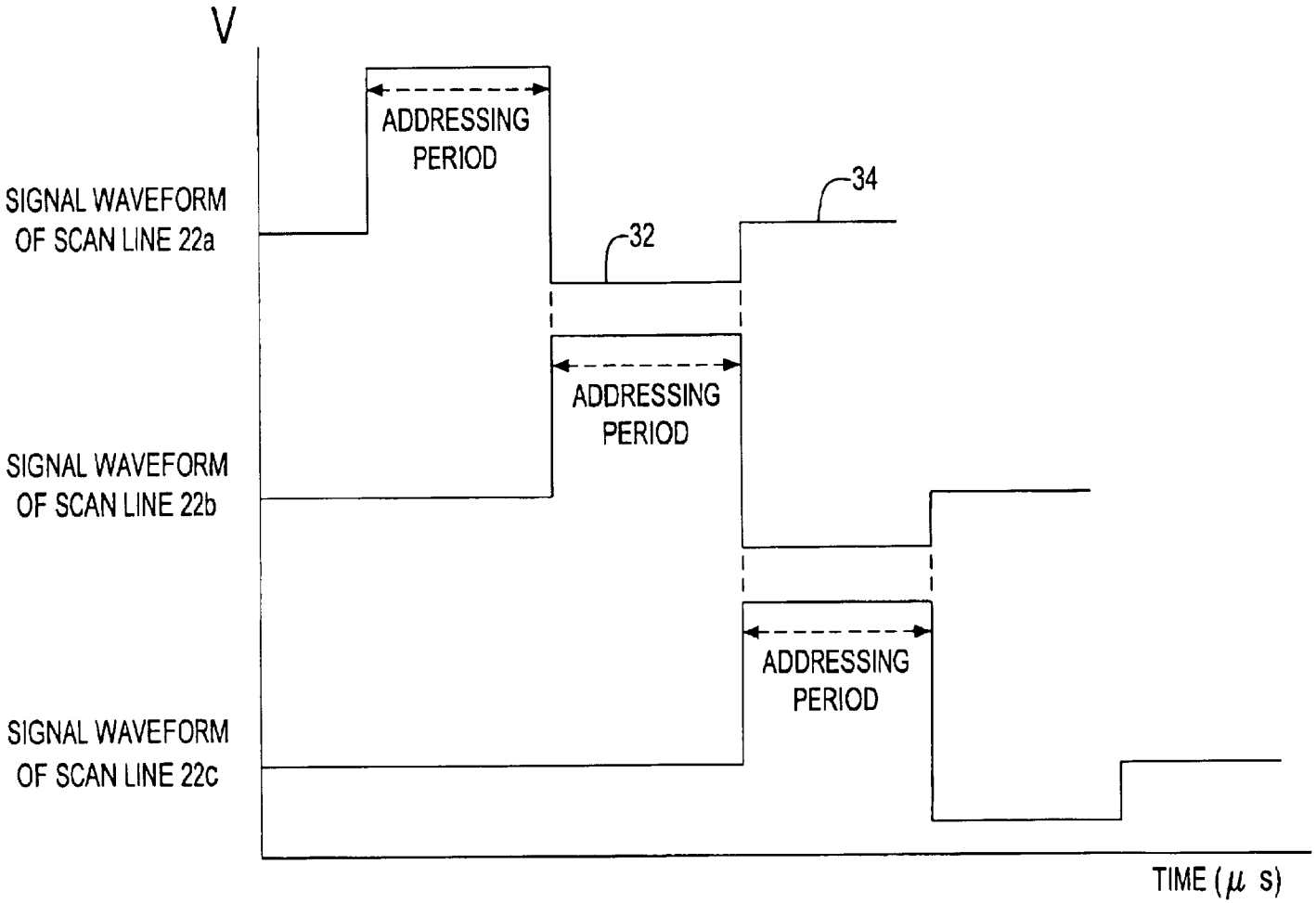
FIG. 3 is a view showing signal waveforms on scan lines according to the embodiment.

FIG. 3 is a view showing the signal waveforms of the scan pulses on the scan lines 22 in the embodiment. As shown in FIG. 3, two levels of voltages are set to the signal waveform of the scan pulse on each scan line (e.g. scan line 22*b*) in the embodiment as a voltage in a driving period when the switching TFT 13, having a gate connected to a particular scan line (22*b*) is turned off by that scan line (22*b*). Of the two voltages, a voltage with a lower value will be hereinafter referred to as an adjustive voltage 32, and a voltage with a higher value will be hereinafter referred to as a normal voltage 34.

A potential difference between the adjustive voltage 32 and the normal voltage 34 in the driving period compensates for the kickback voltage drop arising from the parasitic capacitance of the switching TFT 13. The kickback voltage (delta)Vkb is calculated by the equation below. Note that (delta)Vg denotes the voltage applied to the gate electrode of the driving TFT 12, Cgs denotes parasitic capacitance of the switching TFT 13 and Cs denotes a capacitance of the capacitor 14.

$$\Delta Vkb = \frac{\Delta Vg \cdot Cgs}{Cgs + Cs}$$

When the addressing period of a certain scan line 22*a* for the preceding stage is terminated and the scan line 22*a* is switched to the driving period, the voltage thereof is first lowered to an adjustive voltage 32. The adjustive voltage 32 continues for an interval of the addressing period of the next scan line 22*b* which started the addressing period (that is, the scan line 22*b* of the current stage in which switching TFT 13 is turned on, according to the scan order). When the scan line 22*b* of the current stage is switched to the driving period, switching TFT 13 turns off and the scan line 22*a* is raised from the adjustive voltage to the normal voltage, such that the capacitor 14 output voltage provided to the gate of driving TFT 12 is raised to compensate for the kickback voltage. At that time, scan line 22*b* is then lowered, first to the adjustive voltage 32, then later raised again to the normal voltage 34. In this way, a voltage in an amount to compensate for the kickback voltage arising from the switching TFT 13 is supplemented at the capacitor 14. Accordingly, it is possible to prevent the gate voltage of the driving TFT 12 from being lowered due to the kickback voltage of the switching TFT 13.

Regarding the certain OLED pixel circuit, electric charges accumulate in the capacitor 14 just before the scan line 22*b* is switched to the addressing period, because the preceding scan line 22*a* is in the addressing period. However, considering the scan time on scan line 22*b* and the number of the OLED pixel circuits in the direction of the scan line in the organic EL display, the time when any particular scan line 22 is in the addressing period is deemed extremely short. Accordingly, the effect of such is negligible on the actual image display on a display screen.

Figure 4:
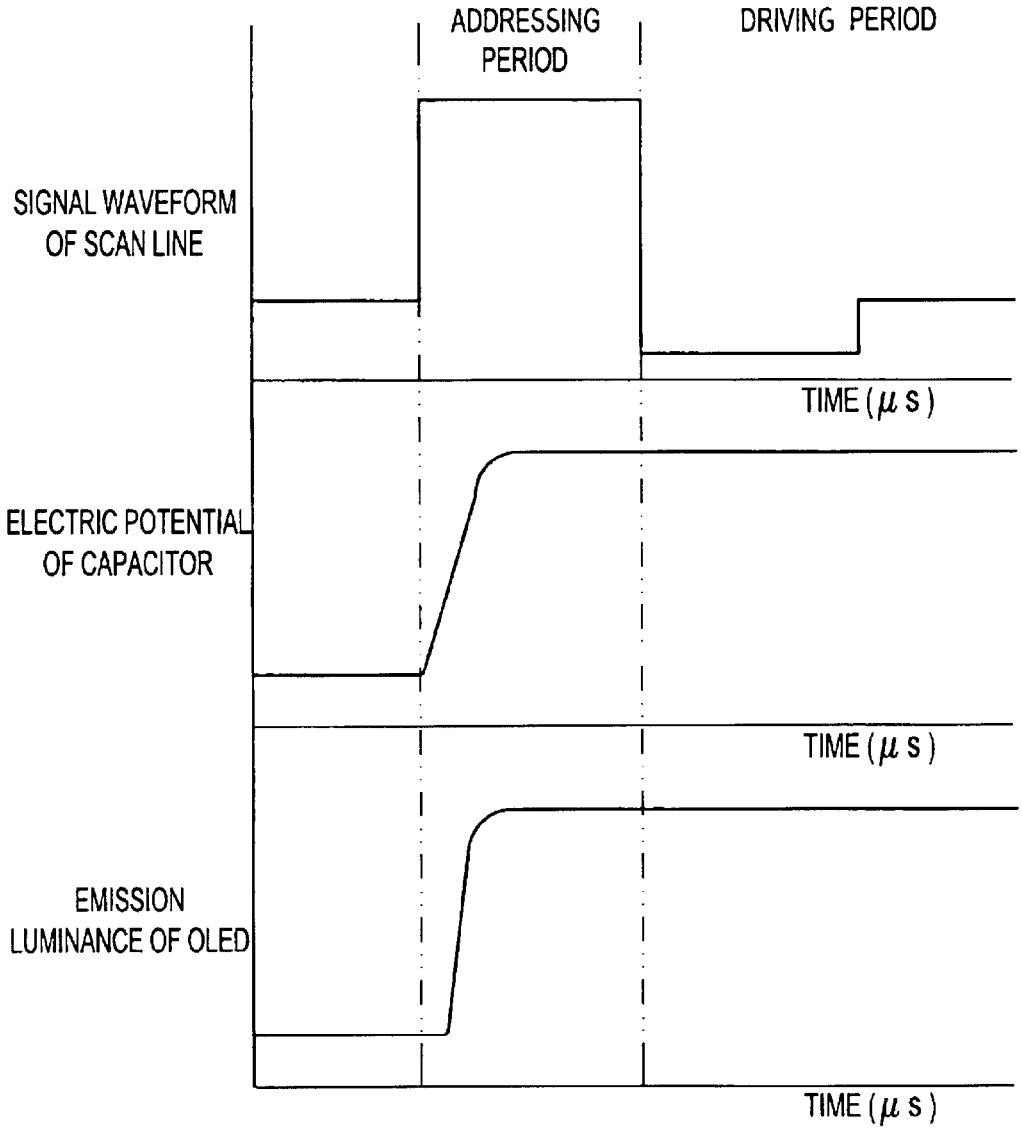
FIG. 4 is a view showing a relationship among the signal waveform on a scan line, electric potential at a capacitor and emission luminance of an OLED according to the embodiment.

FIG. 4 is a view showing the relationship between the signal waveform on a scan line (e.g. 22*b*), the electric potential at the capacitor 14 and emission luminance of the OLED 11 of the embodiment. As shown in FIG. 4, according to the embodiment, the capacitor 14 does not incur a drop in the voltage attributable to the kickback when the signal on scan line (22*b*) is switched from the addressing period to the driving period. In the meantime, the emission luminance of the OLED 11 is maintained.

As described above, in the embodiment, the kickback action at the switching TFT 13 is offset by raising a reference voltage applied to capacitor 14 from the adjustive voltage 32 to the normal voltage 34 when the kickback voltage is present. In such manner, the effect of the kickback voltage is decreased, without requiring any new circuit element to be added to the OLED pixel circuit or the pixel array. In other words, it is not necessary to increase the width of the scan line 22 and/or increase the capacitance of the capacitor 14 in order to reduce the influence by the kickback voltage. Therefore, the area of the OLED pixel circuit which contributes to emission is not reduced.

Moreover, since the emission-contributable area is not reduced, it is not necessary to increase an electric current to be supplied to the OLED 11 in order to enhance emission efficiency of the OLED pixel circuit. Accordingly, there is no risk of shortening the life of the OLED 11 needlessly.

Figure 8:
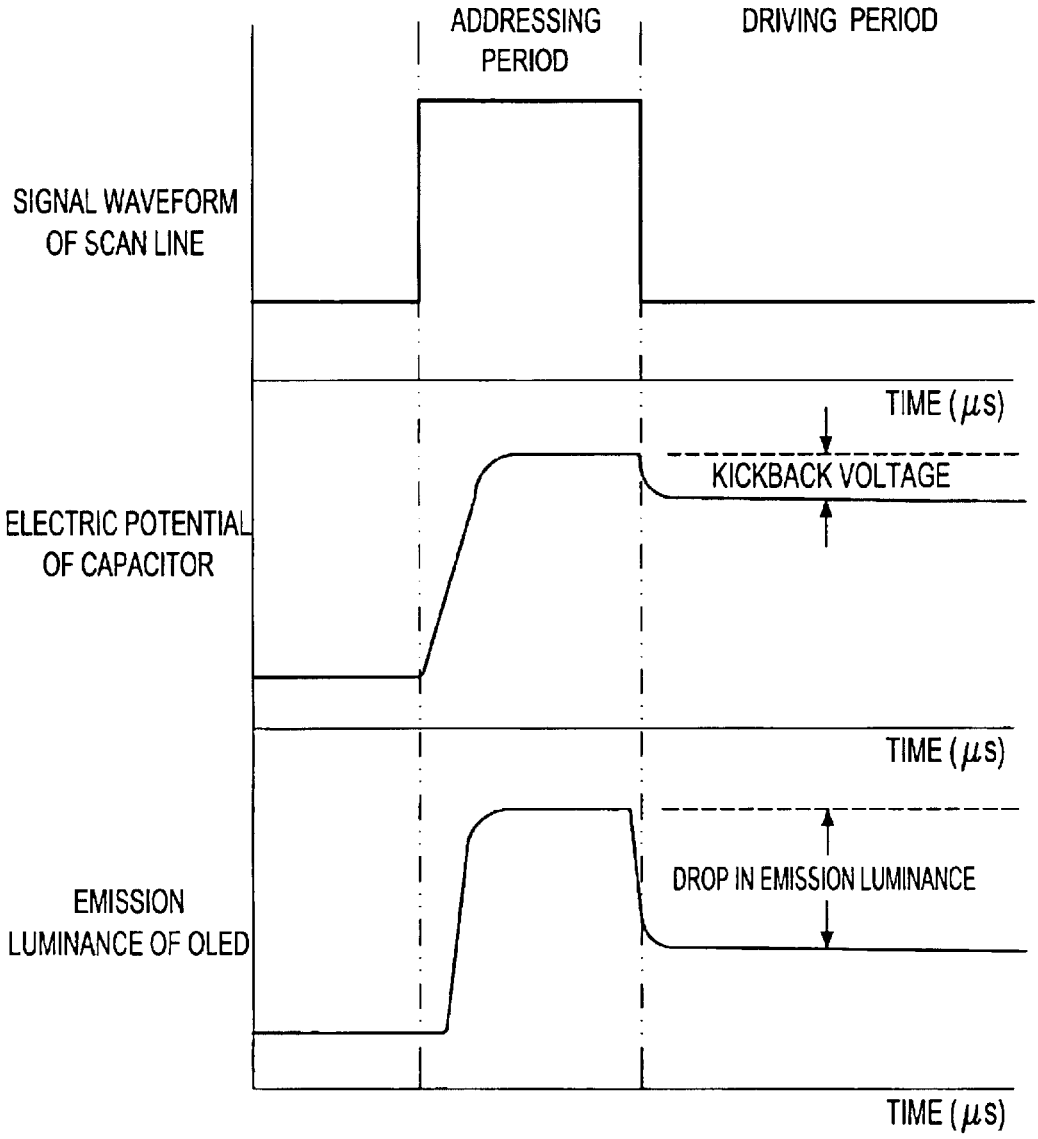
FIG. 8 (PRIOR ART)
FIG. 8 is a prior art circuit timing diagram showing the relationship among a signal waveform on a scan line, the electric potential of a capacitor and the emission luminance of a prior art OLED pixel circuit.
Figure 9:
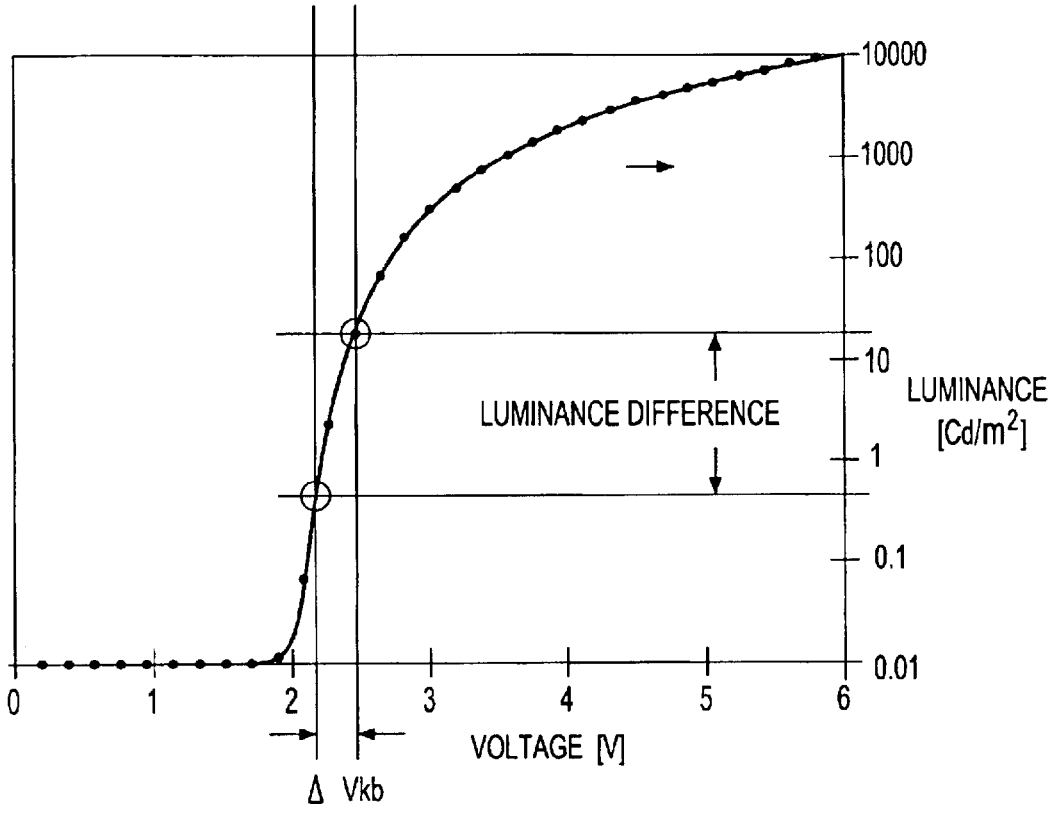
FIG. 9 (PRIOR ART)
FIG. 9 is a graph illustrating an example of a relationship between driving voltage, change due to kickback voltage, and a light emission characteristic of a conventional OLED.

It will be understood that in the conventional circuit described above relative to FIGS. 7 through 9, as displays are made larger in scale or higher in resolution, the scan time on each scan line 722 is shortened. However, if an attempt is made to suppress the kickback voltage by increasing the capacitance of the capacitor 714, then the capacitor 714 must be charged more quickly to accommodate the faster scan time in such larger/more highly resolved displays. As a result, it is necessary to enlarge the switching TFT 713 or increase a width of the signal line 723 to increase current. In such case, the storage capacitor is also increased to match the enlarged switching TFT 713. Accordingly, it is necessary to increase the capacitance of the capacitor 714 in order to suppress the kickback voltage. These changes require the scan line 722 to be made wider. However, in so doing, the emission-contributable area of the OLED pixel electrode is further reduced. In addition, the emission-contributable area of the OLED pixel circuit is also reduced by increasing the width of the signal line 723.

By contrast, in the present embodiment, the kickback voltage is suppressed not by increasing the capacitance of the capacitor 14 but by raising a reference potential of capacitor 14 and thereby raising its output voltage derived therefrom at a gate of driving TFT 12. Accordingly, even if the capacitor 14 must be charged quickly, this can be done without requiring the switching TFT 13 or the width of the signal line 23 to be enlarged. In this way, the embodiment does not interfere with providing large-scaling or higher resolution of a display device.

In the above-described example, the capacitor 14 is connected to the preceding scan line 22 in accordance with the scanning order, and the output voltage of the capacitor 14 is raised by the dynamic signal waveform on the scan line 22. However, if another signal line is arranged to be connected to the capacitor 14 and if the signal line transmits a signal corresponding to the adjustive voltage 32 and the normal voltage 34 as illustrated in FIG. 3 and FIG. 4, it is also possible to suppress the drop in the voltage attributable to the kickback by adjusting the reference potential, and hence the output voltage of the capacitor 14. In this case, since the other signal line is arranged on the display panel of the organic EL display, the emission-contributable area of each of the OLED pixel circuits will be equivalently reduced. Therefore, if necessary, a hardware measure such as a measure to increase the electric current to be supplied to the OLED 11 may be adopted. Moreover, since another signal, apart from the scan pulse, is generated and supplied, another signal generator and driver must be provided therefor on the organic EL display.

It will be understood, considering that a plurality of OLED pixel circuits are coupled to each scan line 22, the signal waveform (the scan pulse) becomes dull at a terminal end (far end) of the scan line 22, as compared to the signal waveform at a feeding edge (driving end) thereof, due to propagation on the scan line 22. For this reason, the effective time interval to turn on the switching TFT 13 is shortened, thus causing insufficient writing (insufficient charging) of capacitor 14.

Figure 5:
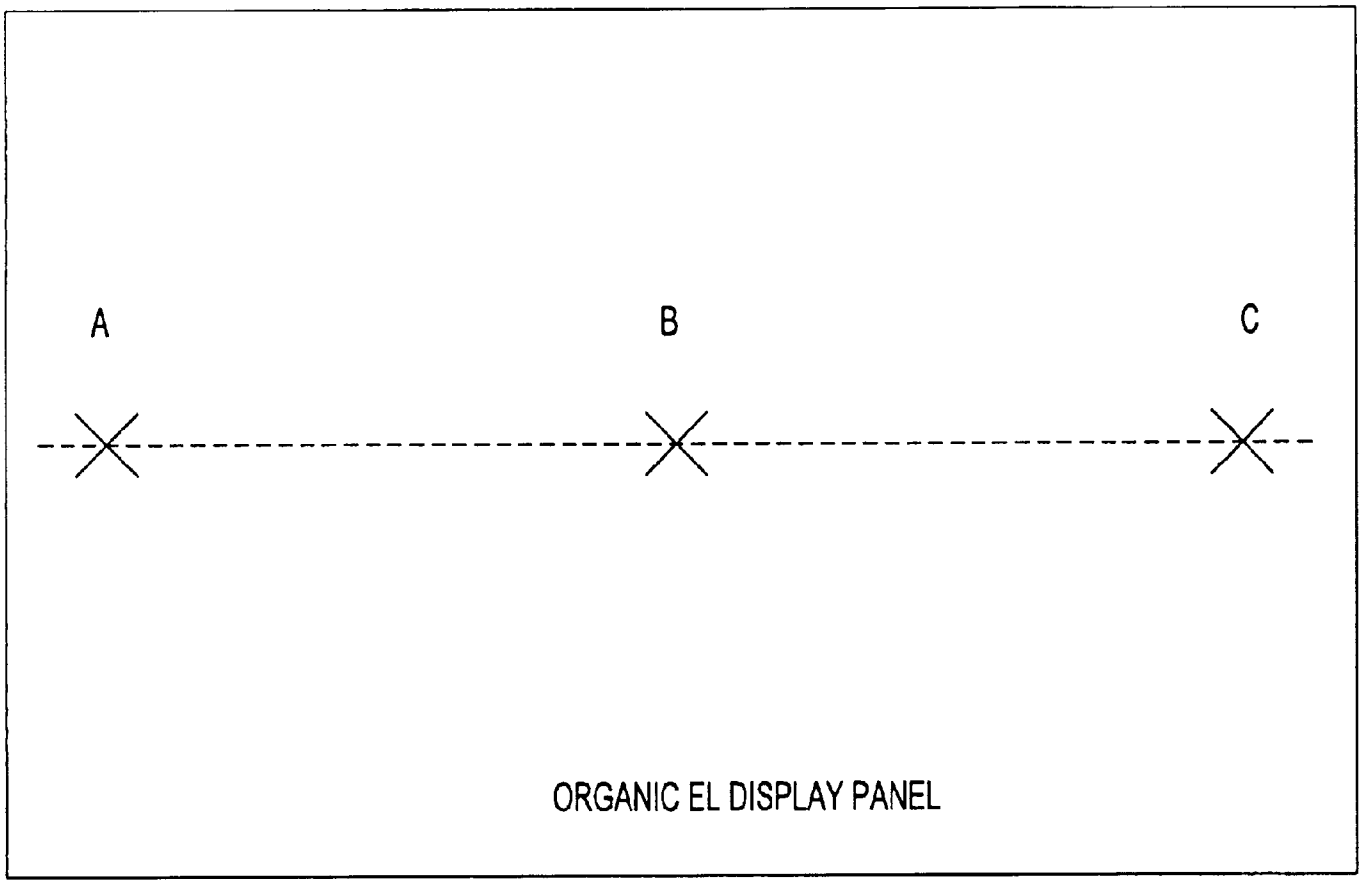
FIG. 5 is a view illustrating points on a given scan line in an organic EL display, namely, a position near a feeding edge (Position A), a position near a center (Position B) and a position near a terminal end (Position C).
Figure 6:
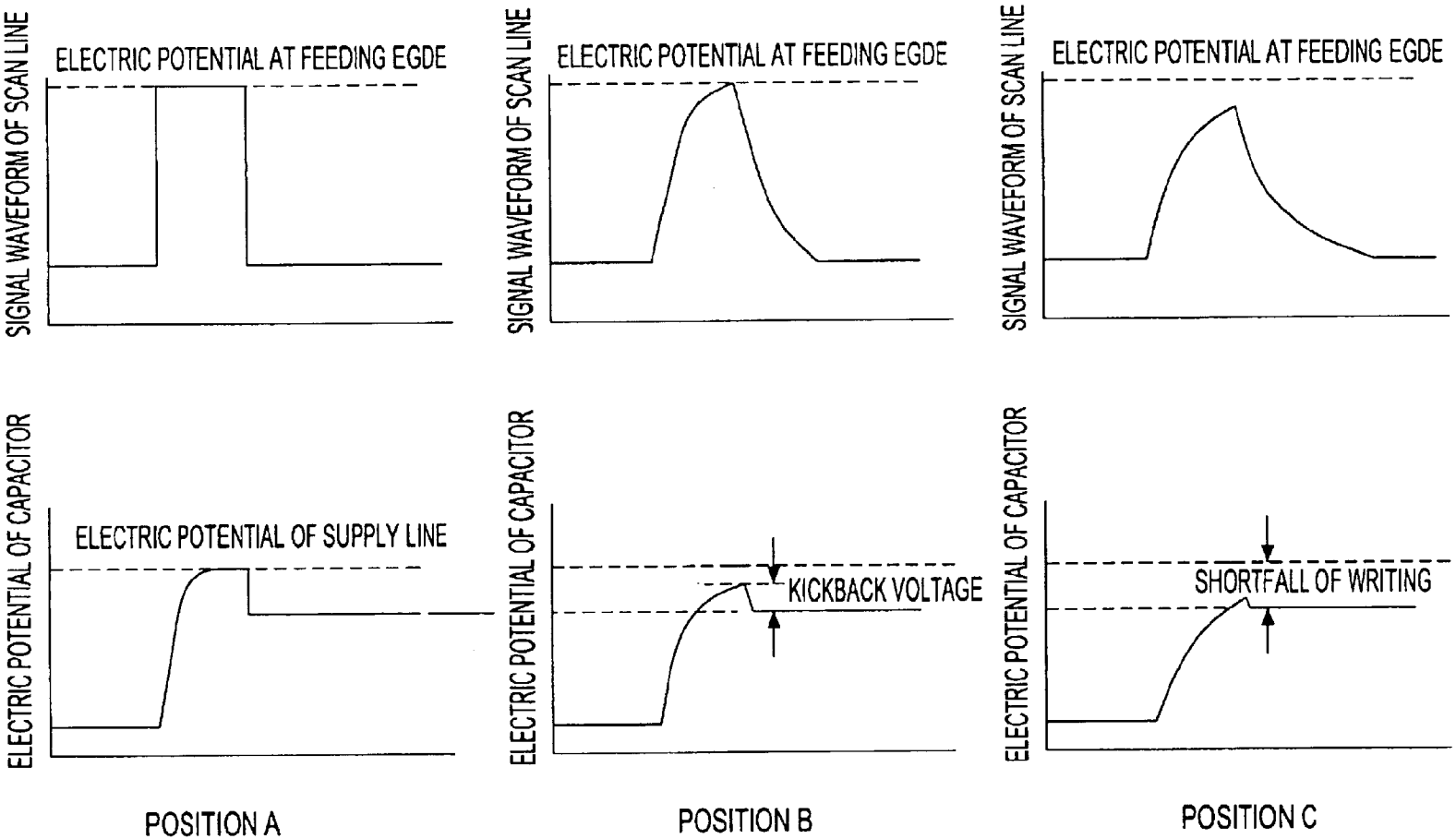
FIG. 6 is a set of graphs showing correspondences between signal waveforms of the scan lines and writing voltages of capacitors in the respective positions shown in FIG. 5.

FIG. 5 illustrates points on a given scan line 22 in an organic EL display, namely, a position near the feeding edge (Position A), a position near the center (Position B) and a position near the terminal end (Position C). FIG. 6 is a set of graphs showing correspondences between the signal waveforms on the scan line 22 and electric potential (output voltages) of the capacitors 14 obtained via the switching TFT's 13 in the respective positions.

With reference to FIG. 6, in Position A, the signal waveform on the scan line 22 has a steep leading edge (or a trailing edge) at a boundary between the addressing period and the driving period, whereby the signal forms a rectangular waveform. By contrast, as the signal progresses to Position B and Position C, a leading edge (or a trailing edge) at the boundary between the addressing period and the driving period becomes dull, whereby the signal waveform changes into a shape closer to a triangular wave. Accordingly, it turns out that the output voltage of the capacitor 14 in the addressing period is gradually reduced as the signal progresses from Position A to Position C.

Here, as shown in FIG. 4, in the OLED pixel circuit using the OLED 11 which is self-emissive element, emission luminance of the OLED 11 is determined by the electric potential of the capacitor 14 after the change due to the kickback voltage. When the target emission luminance of the OLED 11 is set to that resulting from the potential on capacitor 13 when the kickback voltage is present, then it is feasible to achieve luminance uniformity of the organic EL display. In other words, the voltage to be applied to the gate electrode of the driving TFT 12 is made constant regardless of the position on the scan line 22, by arranging an offset between an increase in the scan line writing voltage for supplementing a shortfall in the output voltage of the capacitor 14, and a decrease in the kickback voltage, due to signal propagation. The foregoing arrangement can be determined by simulation using an appropriate simulator while applying parameters of the capacitance of the capacitor 14, line resistance and a line capacitance of the scan line 22, and a W/L ratio of the switching TFT 13.

By performing the foregoing design, the change in reference potential applied to the capacitor 14 is gradually reduced as the signal progresses from Position A to Position C shown in FIG. 5, whereby a drop in the voltage attributable to the kickback hardly occurs in Position C as shown in FIG. 6.

In the pixel array of the OLED pixel circuits thus designed, when the writing voltage is applied in the addressing period to the capacitor 14 positioned near the feeding edge of the scan line 22 such as Position A, a voltage higher than a voltage for obtaining the target luminance in OLED 11 will be applied to the driving TFT 12. However, considering scan time on each scan line 22 and the number of the OLED pixel circuits in the direction of the scan line in the organic EL display, the time when the scan line 22 is in the addressing period is deemed extremely short. Accordingly, in actual image display onto a display screen, an influence attributable to the foregoing can be ignored.

As described above, according to the present invention, accurate gradation display on an OLED display device is effectuated by reducing a kickback voltage based on parasitic capacitance of a switching TFT. In addition, the present invention can also reduce the kickback voltage based on the parasitic capacitance of the switching TFT, without increasing a capacitance of a capacitor which retains a voltage to be supplied to a driving TFT.

Although the preferred embodiment of the present invention has been described in detail, it should be understood that various changes, substitutions and alternations can be made therein without departing from spirit and scope of the inventions as defined by the appended claims.

What is claimed is:

1. A method of driving a pixel circuit having an electroluminescent element, said method comprising:

charging a capacitor connected to a scan line, for applying a voltage to a gate electrode of a driving thin-film transistor to drive said electroluminescent element by turning on a switching thin-film transistor; and turning the switching thin-film transistor off and increasing a reference potential of said capacitor to compensate fir a drop in a gate voltage of said driving thin-film transistor attributable to parasitic capacitance of said switching thin-film transistor.

2. The method of claim 1 wherein said reference potential is increased from an adjustable voltage to a normal voltage when said switching thin-film transistor is turned off.

3. A method of driving a pixel circuit having an electroluminescent element, a driving thin-film transistor driving said electroluminescent element and a capacitor applying a voltage to a gate electrode of said driving thin-film transistor, said method comprising:

controlling a switching thin-film transistor to charge said capacitor connected to a scan line and coupled to a signal line through said switching thin-film transistor; and altering a reference voltage provided to said capacitor when said switching thin-film transistor switches between on and off states, whereby a gate voltage of said driving thin-film transistor is adjusted by said altered voltage provided to said capacitor.

4. The method of claim 3, wherein said reference voltage rises to compensate for a drop in a gate voltage of said driving thin-film transistor based on parasitic capacitance of said switching thin-film transistor when said switching thin-film transistor is turned off.

5. The method of claim 3 wherein said reference voltage is altered by a change in a scan signal voltage provided to said capacitor.

6. The method to claim 5 wherein said scan signal voltage is lowered temporarily from a normal voltage while said switching thin-film transistor is turned on, during an addressing period of said switching thin-film transistor, and increased to said normal voltage when said switching thin-film transistor is turned off.

7. A pixel circuit comprising:

an electroluminescent element;

a driving thin-film transistor configured to supply a drive current to said electroluminescent element;

a switching thin-film transistor coupled to said driving thin-film transistor, said switching thin-film transistor configured to control on/off switching of said driving thin-film transistor; and a capacitor connected to a scan line and coupled to be charged under control of said switching thin-film transistor and configured to maintain on and off states of said driving thin-film transistor, said capacitor further being coupled to a variable reference potential, said variable reference potential configured to be varied to compensate for a temporary change in a gate voltage of said driving thin-film transistor during operation.

8. The pixel circuit of claim 7 wherein said variable reference potential is provided by said scan line connected to said capacitor, said scan line controlling addressing of a switching thin-film transistor in a said pixel circuit of a preceding stage of an electroluminescent pixel array.

9. The pixel circuit according to claim 8, wherein a voltage of said scan line is altered by an amount to compensate for a change in gate voltage of said driving thin-film transistor due to parasitic capacitance of said switching thin-film transistor.

10. An electroluminescent display, comprising:

an array in which pixel circuits having electroluminescent element are arranged in a matrix; and a plurality of scan lines provided in parallel between said pixel circuits of said array, said scan lines configured to supply scan signals to said pixel circuits to instruct imaging timing, wherein each of said pixel circuits includes:

a driving thin-film transistor configured to supply a drive current to said electroluminescent element;

a switching thin-film transistor configured to control on and off switching of said driving thin-film transistor; and a capacitor connected to a scan line and coupled to be charged under control of said switching thin-film transistor, said capacitor maintaining on and off states of said driving thin-film transistor, wherein said scan lines are further configured to supply control signals to control an electric potential of respective capacitors of said array, and wherein a voltage on at least one of said scan lines is lowered from a normal voltage during a driving period for turning said switching thin-film transistor off for an interval lasting as long as an addressing period for turning said switching thin-film transistor on in a subsequent stage of said array.

11. The electroluminescent display of claim 10, wherein said scan line is connected to said switching thin-film transistor and to said capacitor in a said pixel circuit of a subsequent stage of said array, in accordance with a scanning order, and said scan line supplies a control signal for controlling an electric potential of said capacitor connected to said scan line.

12. The electroluminescent display of claim 11, wherein said capacitor is charged to apply a voltage to a gate electrode to drive said electroluminescent element by turning said switching thin-film transistor on, and by then turning said switching thin-film transistor off and by changing a reference potential of said capacitor to compensate for a drop in the gate voltage of said driving thin-film transistor attributable to a parasitic capacitance of said switching thin-film transistor.

* * * * *